United States Patent [19]

Wafer

[11] 4,445,732

[45] May 1, 1984

[54] ELECTRICAL STAB CONNECTING MEANS UTILIZING EDDY CURRENT ELECTROMAGNETIC REPULSION

[75] Inventor: John A. Wafer, Brighton Township, Beaver County, Pa.

[73] Assignee: Westinghouse Electric Corp., Pittsburgh, Pa.

[21] Appl. No.: 347,824

[22] Filed: Feb. 11, 1982

[51] Int. Cl.[3] ..... H01R 11/30

[52] U.S. Cl. ..... 339/12 R; 339/255 P

[58] Field of Search ..... 339/12, 69 R, 69 M, 339/25 BR, 22 B, 255 P, 25 BA, 24

[56] References Cited

U.S. PATENT DOCUMENTS 3,180,924 4/1965 Rowe ..... 339/22 B X

FOREIGN PATENT DOCUMENTS 133875 1/1979 German Democratic Rep. ..... 339/255 P 1416565 9/1965 France ..... 339/255 P

*Primary Examiner*—Eugene F. Desmond

*Attorney, Agent, or Firm*—Benjamin Hudson, Jr.

[57] ABSTRACT

There is provided by this invention an eddy current bus means in combination with a plurality of electrical contact fingers disposed to make contact with an electrical bus means whereby said eddy current bus means generates electromagnetic forces that cause increased electrical contact pressure between said plurality of electrical contact fingers and said electrical bus means.

4 Claims, 5 Drawing Figures

ELECTRICAL STAB CONNECTING MEANS UTILIZING EDDY CURRENT ELECTROMAGNETIC REPULSION

BACKGROUND OF THE INVENTION

1. Field of the Invention

This invention relates generally to plug-in type electrical apparatus having stab connectors and more particularly electrical apparatus having stab connectors and utilizing electromagnetic repulsion forces for generating contact pressure.

2. Description of the Prior Art

In plug-in type electrical apparatus, a terminating system is utilized that is generally comprised of a main bus arrangement disposed to receive a plurality of parallel contact fingers which make contact at each side of the bus having some biasing means to maintain pressure between the contact fingers to form a desirable electrical connection with the bus means therebetween. Sufficient pressure must be maintained on the contact fingers because if they should part arcing and overheating may result and serious damage to the bus means and electrical connectors may also result. When a large current flows, these fingers are pulled together by electromagnetic attractive forces. For smaller currents, springs or other biasing means are provided to maintain contact force. One example of such a system is disclosed in U.S. Pat. No. 3,869,192 issued to Alfred E. Maier, et al. on Mar. 4, 1975 and assigned to the assignee of the present application. The number of contact fingers utilized and the contact force applied is chosen to meet both the thermal and current-carrying capabilities of the apparatus. However, in designing plug-in type electrical apparatus to maintain a predetermined contact pressure, it has been found that for higher contact pressure requirements, it is increasably difficult to plug in the electrical apparatus. Forcing the electrical apparatus in place can result in damage to the bus means and also cause damage to the biasing means utilized for maintaining the electrical contact pressure.

SUMMARY OF THE INVENTION

There is provided by this invention an electrical stab connector for use in plug-in type electrical apparatus comprised generally of a plurality of electrical contact fingers having a conducting block adjacent to and parallel to said contact fingers in which eddy currents are induced for generating an electromagnetic repulsion force for maintaining sufficient electrical contact pressure. This invention combines an easier plug-in stab connector for plug-in type electrical apparatus with a means for maintaining sufficient contact pressure that results in increasing the overall current-carrying capability of the apparatus.

DESCRIPTION OF THE PREFERRED EMBODIMENTS

Figure 1:
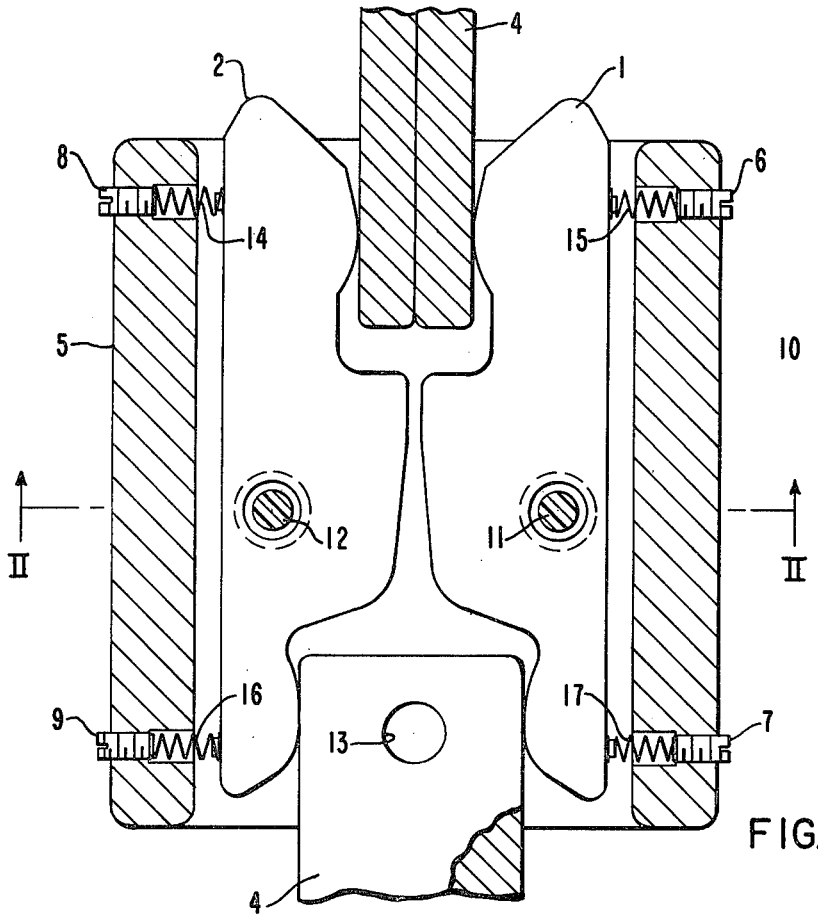
FIG. 1 is a side view partially in elevation and partially in section of a plug-in stab connector in electrical contact with a bus means incorporating the principles of this invention.
Figure 2:
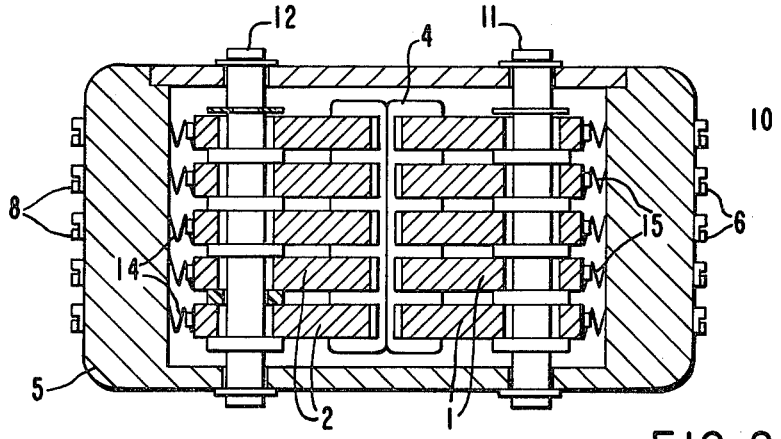
FIG. 2 is a sectional view taken generally along the line II—II of FIG. 1 incorporates the principles of this invention.
Figure 3:
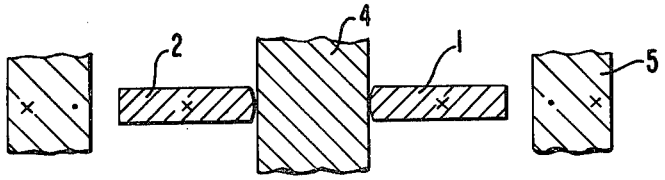
FIG. 3 is a schematic illustrating how the magnetic repulsion force is generated.

Referring now to FIGS. 1, 2 and 3 there is shown a stab connector structure 10 in electrical contact with a bus means 4 having contact fingers 1 and 2 maintaining contact pressure sufficient for the current carrying capability of the associated electrical apparatus (not shown). The contact fingers 1 and 2 are attracted together by an electromagnetic forces at high currents, but the electromagnetic attraction is not large enough to ensure that constant electrical contact is always made with the bus means 4 sufficient for the current carrying capabilities of the associated electrical apparatus. In accordance with the principles of this invention, an eddy current bus 5 is placed outside each of the conducting contact fingers 1 and 2. Eddy currents induced in this bus repel the contact fingers together increasing the required contact force necessary to maintain the proper current carrying capabilities of the associated apparatus as shown in FIG. 3. The conducting bus 5 is generally a rectangular extrusion as shown in FIG. 2, preferably made from aluminum. This bus is also disposed to be formed as a housing for the contact finger assembly providing holes for insulating pins 11 and 12 which allows the contact fingers 1 and 2 to pivot between the closed and open positions. An aperture 13 may also be provided for an insulating bolt to secure the eddy current bus 5 to the bus means 4. Insulating springs 14, 15, 16 and 17 supported to the eddy current bus by means of screws 6, 7, 8, and 9, respectively, provide the contact force.

Figure 4:
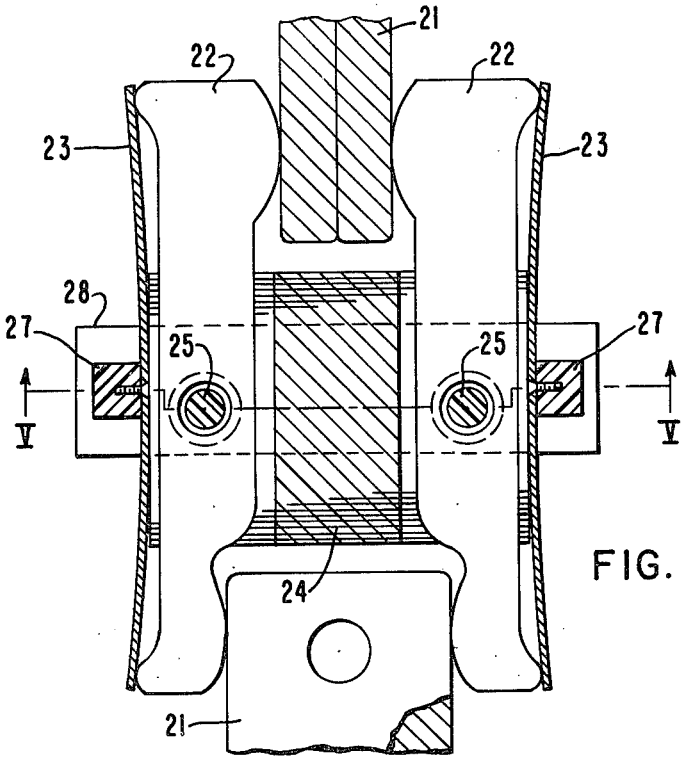
FIG. 4 is a side view partly in elevation and partly in section of an electrical stab connector utilizing a slot-motor as another embodiment.
Figure 5:
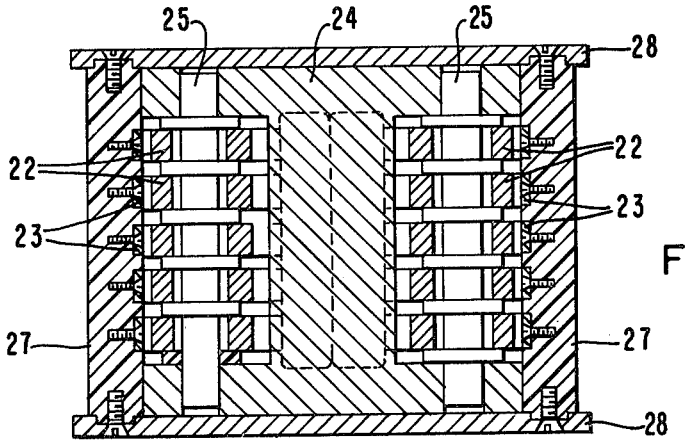
FIG. 5 is a sectional view taken generally along the lines V—V of FIG. 4.

Referring now to FIGS. 4 and 5, there is shown an alternate embodiment also incorporating the principles of this invention. In this embodiment, a slot motor type system is employed that is generally comprised of a laminated soft magnetic yoke 24 disposed generally around contact fingers 22 so that during operation under high currents, the flux generated across the gap in which the contact fingers are located as shown in FIG. 5 results in an electromagnetic attraction in which the contact arms 22 are pulled into the slot to maintain contact pressure with bus means 21. Insulating pins 25 allow each of the contact fingers 22 to pivot from an opened to a closed position. A plate 28 holds the assembly together and insulating pin 27 provides a stop for the cantilever springs 23 which supply the contact force.

It can be readily seen that there is provided by this invention a novel stab type connector means in which plug-in type electrical apparatus can be easily installed and yet proper contact pressure can be maintained with the associated bus means to ensure that the proper current carrying capabilities of the apparatus is achieved.

Although there has been illustrated and described a specific embodiment, it is clearly understood that the same were merely for purposes of illustration and that changes and modifications may be readily made therein by those skilled in the art without departing from the spirit and scope of this invention.

I claim:

1. An electrical stab connector, comprising:

(a) a plurality of electrical contact fingers disposed to make contact with an electrical bus means for supplying electrical power thereto;

(b) an eddy-current bus means for carrying eddy-currents disposed in a position generally parallel with said plurality of electrical contact fingers;

(c) an air gap isolating said eddy-current bus means from said plurality of electrical contact fingers; and (d) said eddy-current bus means is comprised of an electrical conducting material whereby eddy-currents are induced into said eddy-current bus means to create electromagnet forces that repel said plurality of electrical contact fingers into engagement with said electrical bus means.

2. An electrical stab connector as recited in claim 1 wherein said eddy current bus means is comprised of aluminum.

3. An electrical stab connector as recited in claim 1 wherein said eddy current bus means is comprised of copper.

4. An electrical stab connector, comprising:

(a) a plurality of electrical contact fingers disposed to make contact with an electrical bus means for supplying electrical power thereto;

(b) an eddy-current bus means for carrying eddy-currents induced from said electrical bus means;

(c) an air gap isolating said eddy-current bus means from said plurality of electrical control fingers; and (d) said eddy current bus means is generally comprised of a slot motor means having a laminated magnetic yoke disposed generally around said plurality of electrical contact fingers whereby magnetic flux generated across an air gap results in magnetic attraction for pulling said contact fingers into a slot to maintain contact pressure with the bus means.

* * * * *